US010062468B1

(12) United States Patent
Strahan et al.

(10) Patent No.: US 10,062,468 B1
(45) Date of Patent: Aug. 28, 2018

(54) BEAM DIFFUSER SELECTOR APPARATUS AND SYSTEM FOR A PARTICLE ACCELERATOR AND METHOD OF USE THEREOF

(71) Applicant: The Boeing Company, Chicago, IL (US)

(72) Inventors: Michael K. Strahan, Ogden, UT (US); David Brent Olsen, Jr., Plain City, UT (US); Dominic John Kobbeman, South Ogden, UT (US); Bryant Geoffrey Heath, Salt Lake City, UT (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/830,668

(22) Filed: Dec. 4, 2017

(51) Int. Cl.
*G21K 1/10* (2006.01)

(52) U.S. Cl.
CPC ..... *G21K 1/10* (2013.01)

(58) Field of Classification Search
USPC ..... 250/396 R
See application file for complete search history.

(56) References Cited

U.S. PATENT DOCUMENTS

| | | | | |
|---|---|---|---|---|
| 2,896,103 | A * | 7/1959 | Farrell | H01J 33/00 250/396 R |
| 5,635,721 | A * | 6/1997 | Bardi | A61N 5/01 250/492.3 |
| 6,293,899 | B1 * | 9/2001 | Sioshansi | A61N 5/1001 600/3 |
| 9,750,123 | B1 | 8/2017 | Heath et al. | |

* cited by examiner

*Primary Examiner* — Kiet T Nguyen
(74) *Attorney, Agent, or Firm* — Economou Silfin LLP; John S. Economou

(57) ABSTRACT

A beam diffuser selector apparatus, system and method for use with a particle accelerator. A movable member has a plurality of beam diffusers mounted thereon, each having a different predetermined thickness. A driving device is coupled to the movable member. The driving device is configured to selectively move the movable member such that a selected one of the beam diffusers is positioned in a test position which is adjacent to an output of the particle accelerator and between the output of the particle accelerator and a device under test. A controller is coupled to the driving device. The controller has a user interface for receiving commands selecting a particular one of the plurality of beam diffusers and provides control signals to the driving device to selectively move the movable member such that the selected one of the plurality of beam diffusers is positioned in the test position.

20 Claims, 5 Drawing Sheets

BEAM DIFFUSER SELECTOR APPARATUS AND SYSTEM FOR A PARTICLE ACCELERATOR AND METHOD OF USE THEREOF

FIELD

This disclosure relates generally to an apparatus, system and method for controlling the output of a particle accelerator used in radiation testing. In particular, this disclosure relates to a beam diffuser selector apparatus and system for a particle accelerator used in radiation testing and a method of use of that beam diffuser selector apparatus.

BACKGROUND

Radiation testing is an important part of product testing that is required for devices that will be used in high-radiation environments. These high-radiation environments may include, for example, outer space and high-altitude flight areas, regions around nuclear reactors and particle accelerators, etc. Particle accelerators are typically used to perform radiation testing. A radiation test customers may request thousands of radiation exposures across dozens of different radiation environments for each device under test. The particle accelerator is usually set to provide a fixed known output and the actual radiation environment provided is controlled by attenuating that output by inserting a beam diffuser in front of the output of the particle accelerator. There are two other ways to control the output of a particle accelerator, by adjusting the tuning of the particle accelerator (commonly referred to as the "accelerator's tune") and by changing the distance between the output of the particle accelerator and the device under test. However, the accurate adjustment to a new output level of the particle accelerator output may require several hours of time. This type of beam output adjustment is not practical for testing involving a number of different type of tests. Furthermore, certain testing may require radiation at levels ranging over several orders of magnitude which requires a test cell having a test track (for a movable platform to hold the device under test) which is longer than practical (e.g., on the order of one thousand feet or so).

The beam diffuser used on the output of the particle accelerator is typically a metallic (e.g., aluminum or tantalum) plate of a predetermined thickness affixed directly over the output. By using a number of different plates, each having a different predetermined thickness, various different radiation environments can be provided. However, the time required to change the configuration between radiation environments can be significant, requiring several minutes for an operator to turn the particle accelerator to an off-state, break the safety interlocks on the test cell door, enter the test cell, manually replace the plate on the front end of the accelerator, reset the safety interlocks on the test cell door, exit the test cell, and turn the particle accelerator back to an on-state. The use of beam diffusers is more practical than adjusting the particle accelerator output or by changing the position of the device under test, but still can add a significant amount of time for the complete test procedure due to the time required for each plate change.

Accordingly, there is a need for an apparatus and method which overcomes the problems recited above.

SUMMARY

In a first aspect a beam diffuser selector apparatus for a particle accelerator includes a movable member having a plurality of beam diffusers mounted thereon. Each of the plurality of beam diffusers has a different predetermined thickness. The beam diffuser selector apparatus also includes a driving device coupled to the movable member. The driving device is configured to selectively move the movable member such that a selected one of the plurality of beam diffusers is positioned in a test position which is adjacent to an output of the particle accelerator and between the output of the particle accelerator and a device under test.

In a further embodiment, the movable member has at least one diagnostic tool mounted thereon and the driving device is configured to selectively move the movable member such that a selected one of the plurality of beam diffusers or a selected one of the at least one diagnostic tool is positioned in the test position. The diagnostic tools may be one or more of a laser apparatus, a phosphor screen, and a radiochromatic film. The movable member may have a partial ring member coupled to a hub member via a plurality of spoke members. The movable member may have a counterweight coupled to the hub member via an additional spoke member. The counterweight may be positioned opposite the partial ring member. The driving device may have a motor that drives a shaft that is connected to the movable member. The motor may be a stepper motor and the driving device may include a resolver coupled to the shaft to provide feedback about a position of the movable member. A controller is coupled to the stepper motor and the resolver. The controller is configured to cause the stepper motor to rotate to position a selected one of the plurality of beam diffusers in the test position. The driving device may be mounted on a moveable platform. A retraction device may be provided that has a pneumatic cylinder coupled to the moveable platform that selectively retracts the movable member away from the output of the particle accelerator.

In a second aspect, a beam diffuser selector system for a particle accelerator has a movable member that has a plurality of beam diffusers mounted thereon. Each of the plurality of beam diffusers has a different predetermined thickness. The beam diffuser selector system also has a driving device coupled to the movable member. The driving device is configured to selectively move the movable member such that a selected one of the plurality of beam diffusers is positioned in a test position which is adjacent to an output of the particle accelerator and between the output of the particle accelerator and a device under test. The beam diffuser selector system further has a controller coupled to the driving device. The controller having a user interface for receiving commands selecting a particular one of the plurality of beam diffusers and configured to provide control signals to the driving device to cause the driving device to selectively move the movable member such that the selected one of the plurality of beam diffusers is positioned in the test position.

In a further aspect, the movable member has at least one diagnostic tool mounted thereon. The driving device is configured to selectively move the movable member such that a selected one of the at least one beam diffuser or a selected one of the at least one diagnostic tool is positioned in the test position. The user interface is for receiving commands selecting a particular one of the plurality of beam diffusers or of the at least one diagnostic tool. The controller is configured to provide control signals to the driving device to cause the driving device to selectively move the movable member such that the selected particular one of the plurality of beam diffusers or of the at least one diagnostic tool is positioned in the test position.

In a third aspect, a method of operating a beam diffuser selector apparatus for a particle accelerator is described. The beam diffuser selector apparatus includes a movable member having a plurality of beam diffusers mounted thereon. Each of the plurality of beam diffusers has a different predetermined thickness. The beam diffuser selector apparatus also includes a driving device coupled to the movable member. According to the method, one of the plurality of beam diffusers is selected for use in a test. Then, the driving device is caused to move the movable member such that the selected one of the plurality of beam diffusers is positioned in a test position which is adjacent to an output of the particle accelerator and between the output of the particle accelerator and a device under test.

In a further embodiment, the movable member may be retracted away from the output of the particle accelerator once the test is complete.

The features, functions, and advantages that have been discussed can be achieved independently in various embodiments or may be combined in yet other embodiments, further details of which can be seen with reference to the following description and drawings.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
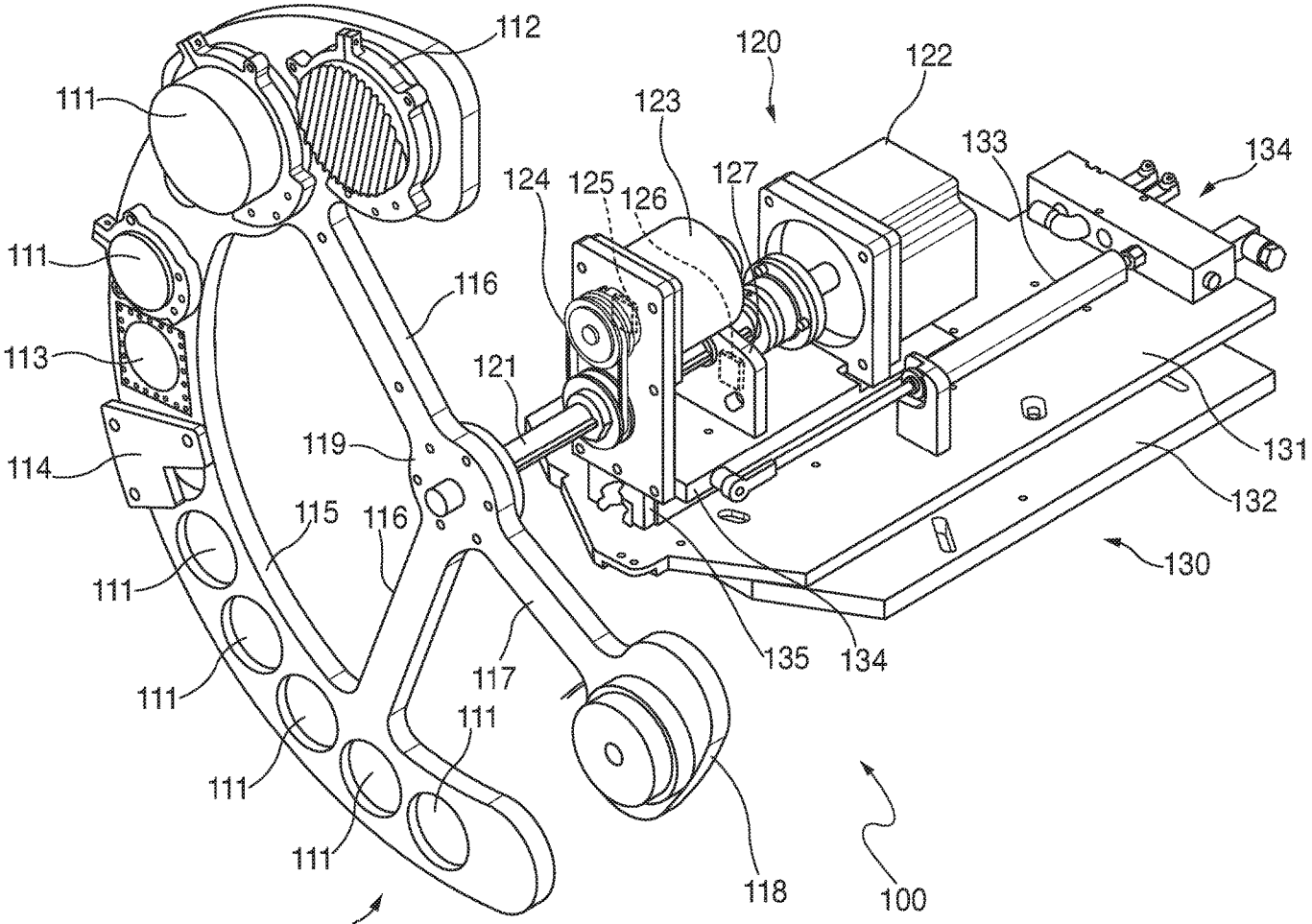
FIG. 1 is a diagram of a perspective view of a beam diffuser selector apparatus according to the present disclosure.

Referring now to FIG. 1, a beam diffuser selector apparatus 100 is shown which provides a number of advantages when used with a particle accelerator to perform radiation testing. In particular, beam diffuser selector apparatus 100 both increases the capabilities of the associated particle accelerator (e.g., by allowing the selection of a different types of beam diffusers and also diagnostic tools) and increases the number of radiation exposures within the same time frame because the selection of different beam diffusers or diagnostic tools is done remotely. Since a change of beam diffusers or diagnostic tools is performed via a remote interface (discussed below), there is no need to turn the particle accelerator to an off-state, break the safety interlocks on the test cell door, enter the test cell, manually replace the plate on the front end of the accelerator, reset the safety interlocks on the test cell door, exit the test cell, and turn the particle accelerator back to an on-state as previously required. This provides a very significant time-savings when performing device testing at different radiation levels, for example, greatly reducing the downtime of the particle accelerator and providing the ability to test many more devices in a given timeframe. Furthermore, the ability to select diagnostic tools as well as beam diffusers allow an operator to verify and adjust certain particle accelerator performance characteristics (e.g., particle beam shape, position, and alignment with the device under test).

Figure 2:
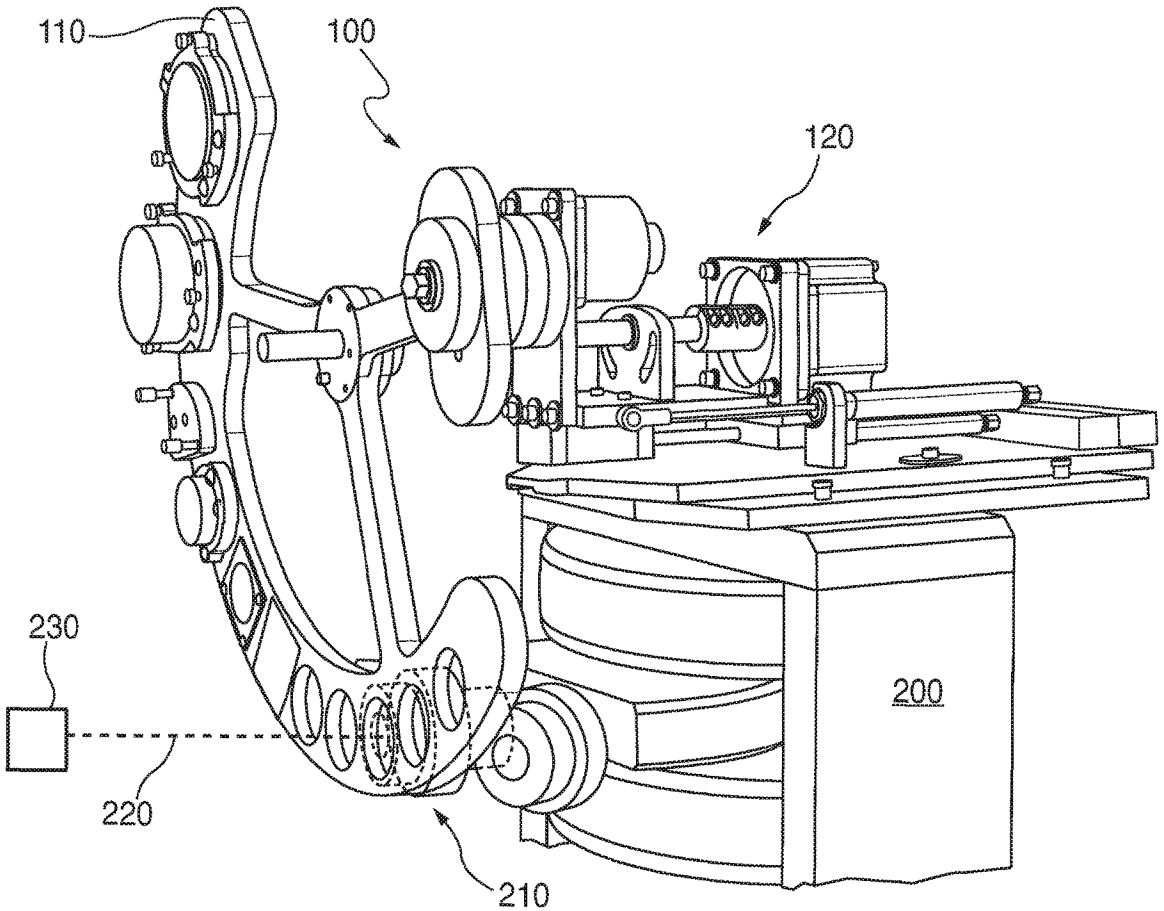
FIG. 2 is a diagram of a perspective view of a beam diffuser selector apparatus mounted on a particle accelerator in an operating position according to the present disclosure.

Beam diffuser selector apparatus 100 includes a movable member 110 having a plurality of beam diffusers 111 mounted thereon. Each of the plurality of beam diffusers 111 has a different predetermined thickness such that a plurality of different radiation levels may be provided to a device under test depending on which beam diffuser is selected. A driving device 120 is coupled to the movable member 110. Driving device 120 selectively moves the movable member 110 so that a selected one of the plurality of beam diffusers 111 is positioned in a test position which is adjacent to an output of the particle accelerator and between the output of the particle accelerator and a device under test (as shown in FIG. 2). The beam diffusers 111 may be formed from aluminum with different thicknesses (e.g., ranging from ⅛" to 2"). In addition, one of the beam diffusers 111 may be formed from tantalum to allow bremsstrahlung conversion (i.e., to convert the particle accelerator output into x-rays).

The movable member 110 may also have diagnostic tools 112, 113, 114 mounted thereon. Diagnostic tool 112 is a laser apparatus used for alignment of the device under test. Diagnostic tool 113 is a phosphor screen used to identify the beam shape exiting the output of the particle accelerator. Diagnostic tool 114 is a radiochromatic film that is used to see beam alignment relative to the output of the of particle accelerator. Other diagnostic tools may be included as known in the art, for example a faraday cup for use in determining beam spectrum. When diagnostic tools are included on movable member 110, the driving device 120 selectively moves movable member 110 such that a selected one of the plurality of beam diffusers 111 or a selected one of the diagnostic tools 112, 113, 114 is positioned in the test position.

Preferably, movable member 110 is formed with a partial ring member 115 that is coupled to a hub member 119 via a plurality of spoke members 116 although other formations may be used for movable member 110. Depending on the number of beam diffusers 111 and diagnostic tools 112, 113, 114 included on partial ring member 115, a counterweight 118 may be included that is coupled to the hub member 119 via an additional spoke member 117, with counterweight 118 positioned opposite the partial ring member 115 to provide balance to movable member 110.

Beam diffuser selector apparatus 100 also includes a driving device 120. Driving device 120 has a motor 122 that drives a shaft 121 that is connected to the hub member 119 of the movable member 110. The motor 122 is preferably a stepper motor to ensure that movable member 110 is accurately and repeatably positioned with respect to the output of the particle accelerator. In addition, driving device 120 also includes a resolver 123 which is coupled to shaft 121 via a one-to-one pulley system 124 to provide feedback about the current position of the movable member 110 with respect, for example, to the output of the particle accelerator to enable more accurate positioning of movable member 110, e.g., preventing any overshoot of rotation. Shaft 121 also passes through a plate 127. Rotational limit switches 125 and 126 may be mounted on plate 127 adjacent to shaft 121 for calibration and protection purposes.

Beam diffuser selector apparatus 100 may further include a movable platform 130. Driving device 120 is mounted on a track mechanism 135 that is secured to movable platform 130. A retraction device 134 is also provided on movable platform 130 which includes a pneumatic cylinder 133 having a first end coupled to the movable platform 130 and a second end coupled to the driving device 120. Retraction device 134 is selectively operated (e.g., via a switch or an external controller) to retract (when movable member 110 is in an extended position) or to extend (when movable member 110 is in a retracted position) movable member 110 away from or towards the output of the particle accelerator. Horizontal limit switches (not shown) may be included that are used to determine whether the movable member 110 is in the extended position or retracted position. The controller may use this positional information to ensure that no rotational motion of movable member 110 is allowed when movable member is in the retracted position.

Referring now to FIG. 2, beam diffuser selector apparatus 100 is shown mounted on top of a particle accelerator 200, with movable member 110 positioned in the extended position. When movable member 110 is in the extended position, rotation thereof causes one of the beam diffusers 111 (or one of the diagnostic tools 112, 113, 114) is positioned adjacent to the output 210 of the particle accelerator 200. During use (i.e., testing of a device under test 230), particle accelerator 200 outputs a beam 220 that passes through one of the beam diffusers 111 (or one of the diagnostic tools 113, 114—diagnostic tool 112 is not used during operation of the particle accelerator) and then strikes a device under test 230. To the extent that additional testing is required at a different level of radiation, an operator may simply cause the associated controller (i.e., controller 420 discussed below with respect to FIG. 4) to operate driving device to rotate movable member 110 to position another of the beam diffusers 111 (which is known to provide the desired level of radiation) at the output 210 of the particle accelerator 200.

Figure 3:
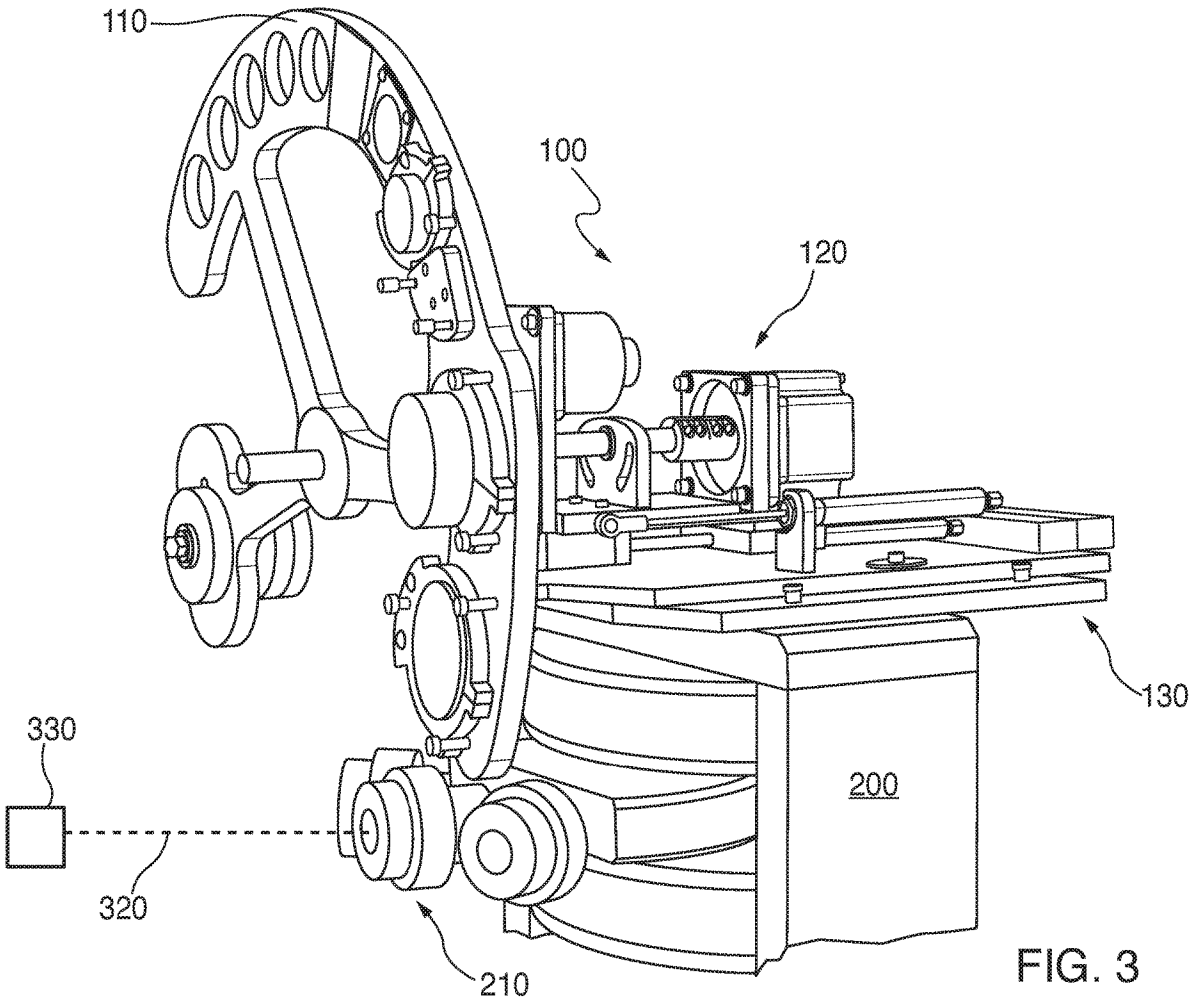
FIG. 3 is a diagram of a perspective view of a beam diffuser selector apparatus mounted on a particle accelerator in a retracted position according to the present disclosure.

Referring now to FIG. 3, beam diffuser selector apparatus 100 is shown mounted on top of a particle accelerator 200, with movable member 110 positioned in the retracted position. In this position, movable member 110 is moved away from the output 210 of particle accelerator 200 such that a beam 320 passes directly to a device under test 330.

Referring back to FIG. 1, movable platform 130 may be formed of two parallel plates 131, 132, with plate 131 over plate 132, which are coupled in a manner that allows plate 131 to be rotated (and thus rotating driving device 120 and movable member 110) with respect to the position of plate 132 (which is secured to an upper surface of the particle accelerator). The ability to rotate plate 131 allows beam diffuser selector apparatus 100 to be used with particle accelerators having angled exit ports (outputs).

Figure 4:
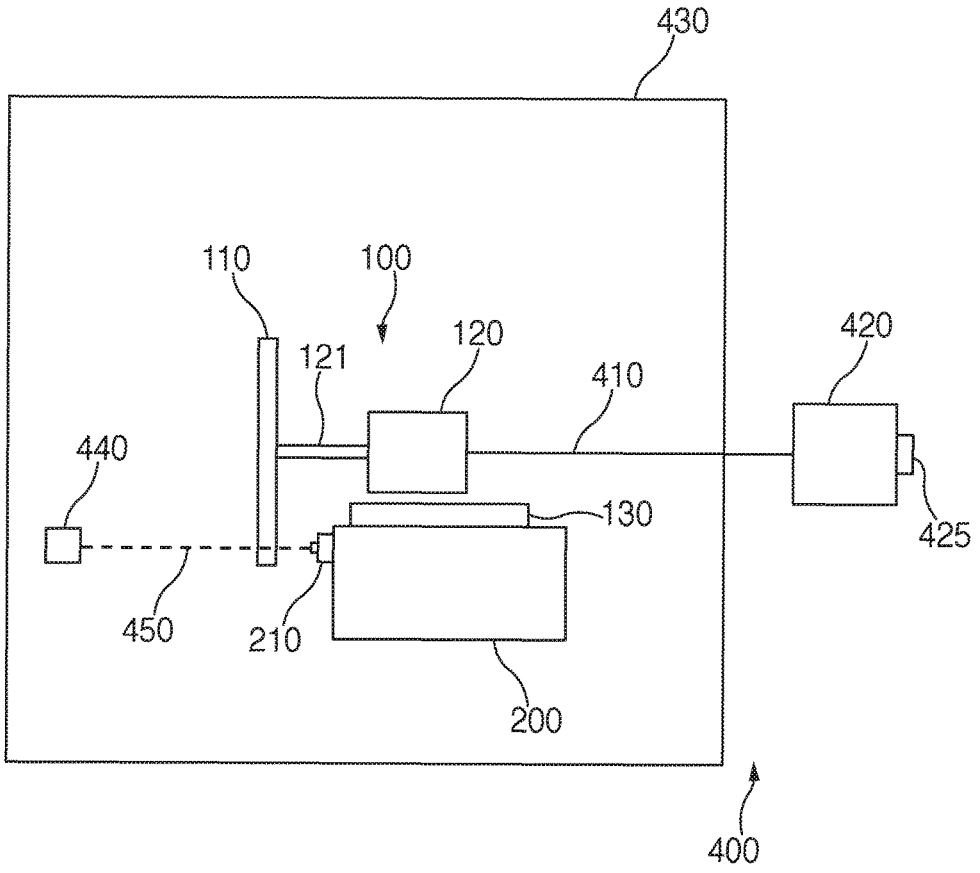
FIG. 4 is a block diagram of a beam diffuser selector system according to the present disclosure.

Referring now to FIG. 4, beam diffuser selector system 400 includes a movable member 110 having a plurality of beam diffusers 111 (shown in FIG. 1) mounted thereon, each of the plurality of beam diffusers 111 having a different predetermined thickness. Beam diffuser selector system 400 also includes a driving device 120 coupled to the movable member 110 via a shaft 121. As described with respect to FIG. 1, driving device 120 selectively moves movable member 110 such that a selected one of the plurality of beam diffusers 111 (or diagnostic tools 112, 113, 114 shown in FIG. 1) is positioned in a test position which is adjacent to an output of the particle accelerator and between the output of the particle accelerator and a device under test 440. Beam diffuser selector system 400 further includes a controller 420 coupled to the driving device 120 by a connection 410. Controller 420 has a user interface 425 for receiving commands from a user selecting a particular one of the plurality of beam diffusers 111 (or diagnostic tools 112, 113, 114). Controller 420 provides control signals to the driving device 120 to cause the driving device 120 to move movable member 110 such that the selected one of the plurality of beam diffusers 111 (or diagnostic tools 112, 113, 114) is positioned in the test position between the output 210 of the particle accelerator 200 and the device under test 440. The particle accelerator 200 outputs a beam 450 that strikes the device under test 440.

Preferably, controller 420 receives feedback signals from resolver 123 and from rotational limit switches 125, 126 which are used to ensure that movable member 110 is accurately positioned at the selected position. As described above, when the beam diffuser selector apparatus 100 and particle accelerator 200 are positioned within a test chamber 430 and the controller 420 is positioned outside the test chamber 430, a test procedure requiring that a device under test 440 be tested at various levels of radiation is performed much more quickly because a test operator will not need to enter the test chamber to change from one beam diffuser to another, a very time consuming process. Instead, the test operator need only enter information onto user interface 425 causing controller 420 to provide signals to driving device 120 that results in movable member rotating to a new position for the newly selected beam diffuser 111. This time savings allows many more tests to be performed within a given timeframe, a great benefit given the cost of a particle accelerator because of the limited downtime.

Figure 5:
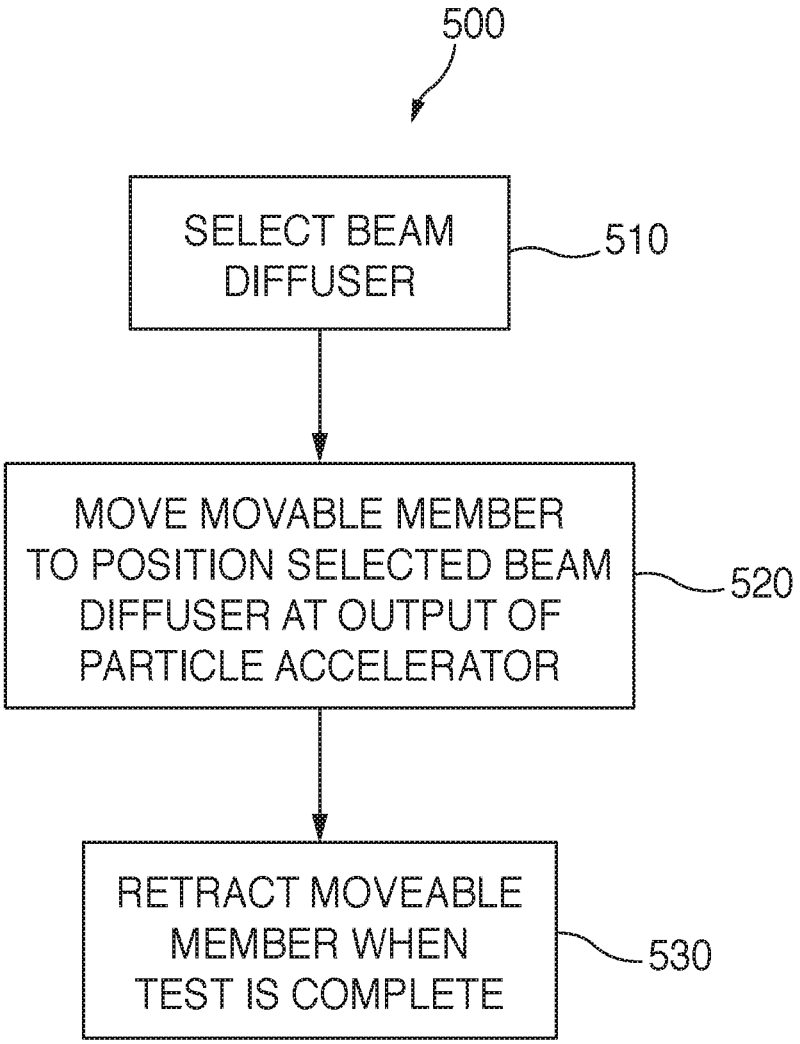
FIG. 5 is a flowchart showing the operation of the beam diffuser selector apparatus during a test procedure according to the present disclosure.

Referring now to FIG. 5, a flowchart 500 is provided for a method of operating the beam diffuser selector apparatus 100 for a particle accelerator 200. As shown in FIG. 1, beam diffuser selector apparatus 100 includes a movable member 110 having a plurality of beam diffusers 111 mounted thereon. Each of the plurality of beam diffusers 111 has a different predetermined thickness. Beam diffuser selector apparatus 100 also includes a driving device 120 coupled to the movable member 110. First, at step 510, one of the plurality of beam diffusers 111 is selected for use in a test. Next, at step 520, the driving device 120 is caused to move the movable member such that the selected one of the plurality of beam diffusers 111 is positioned in a test position which is adjacent to an output 210 of the particle accelerator 200 and between the output 210 of the particle accelerator 200 and a device under test 230. Finally, at step 530 the movable member 110 may optionally be retracted away from the output of the particle accelerator once the test is complete.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A beam diffuser selector apparatus for a particle accelerator, comprising:

a movable member having a plurality of beam diffusers mounted thereon, each of the plurality of beam diffusers having a different predetermined thickness; and a driving device coupled to the movable member, the driving device configured to selectively move the movable member such that a selected one of the plurality of beam diffusers is positioned in a test position which is adjacent to an output of the particle accelerator and between the output of the particle accelerator and a device under test.

2. The beam diffuser selector apparatus of claim 1, wherein the movable member has at least one diagnostic tool mounted thereon; and wherein the driving device is configured to selectively move the movable member such that a selected one of the plurality of beam diffusers or a selected one of the at least one diagnostic tool is positioned in the test position.

3. The beam diffuser selector apparatus of claim 2, wherein the at least one diagnostic tool is one or more of a laser apparatus, a phosphor screen, and a radiochromatic film.

4. The beam diffuser selector apparatus of claim 1, wherein the movable member has a partial ring member coupled to a hub member via a plurality of spoke members.

5. The beam diffuser selector apparatus of claim 4, wherein the movable member has a counterweight coupled to the hub member via an additional spoke member, the counterweight positioned opposite the partial ring member.

6. The beam diffuser selector apparatus of claim 1, wherein the driving device has a motor that drives a shaft that is connected to the movable member.

7. The beam diffuser selector apparatus of claim 6, wherein the motor is a stepper motor; and wherein the driving device has a resolver coupled to the shaft to provide feedback about a position of the movable member.

8. The beam diffuser selector apparatus of claim 7, further comprising a controller coupled to the stepper motor and the resolver, the controller configured to cause the stepper motor to rotate to position a selected one of the plurality of beam diffusers in the test position.

9. The beam diffuser selector apparatus of claim 1, wherein the driving device is mounted on a moveable platform and further comprising a retraction device that has a pneumatic cylinder coupled to the moveable platform that selectively retracts the movable member away from the output of the particle accelerator.

10. A beam diffuser selector system for a particle accelerator, comprising:

a movable member having a plurality of beam diffusers mounted thereon, each of the plurality of beam diffusers having a different predetermined thickness;

a driving device coupled to the movable member, the driving device configured to selectively move the movable member such that a selected one of the plurality of beam diffusers is positioned in a test position which is adjacent to an output of the particle accelerator and between the output of the particle accelerator and a device under test; and a controller coupled to the driving device, the controller having a user interface for receiving commands selecting a particular one of the plurality of beam diffusers and configured to provide control signals to the driving device to cause the driving device to selectively move the movable member such that the selected one of the plurality of beam diffusers is positioned in the test position.

11. The beam diffuser selector system of claim 10, wherein the movable member has at least one diagnostic tool mounted thereon; wherein the driving device is configured to selectively move the movable member such that a selected one of the plurality of beam diffusers or a selected one of the at least one diagnostic tool is positioned in the test position; wherein the user interface is for receiving commands selecting a particular one of the plurality of beam diffusers or of the at least one diagnostic tool; and wherein the controller is configured to provide control signals to the driving device to cause the driving device to selectively move the movable member such that the selected particular one of the plurality of beam diffusers or of the at least one diagnostic tool is positioned in the test position.

12. The beam diffuser selector system of claim 11, wherein the at least one diagnostic tool is one or more of a laser apparatus, a phosphor screen, and a radiochromatic film.

13. The beam diffuser selector system of claim 10, wherein the movable member has a partial ring member coupled to a hub member via a plurality of spoke members.

14. The beam diffuser selector system of claim 13, wherein the movable member has a counterweight coupled to the hub member via an additional spoke member, the counterweight positioned opposite the partial ring member.

15. The beam diffuser selector system of claim 10, wherein the driving device has a motor that drives a shaft that is connected to the movable member.

16. The beam diffuser selector system of claim 15, wherein the motor is a stepper motor; and wherein the driving device has a resolver coupled to the shaft to provide feedback about a position of the movable member.

17. The beam diffuser selector system of claim 16, wherein the controller is coupled to the stepper motor and the resolver and is configured to cause the stepper motor to rotate to position a selected one of the plurality of beam diffusers in the test position.

18. The beam diffuser selector system of claim 10, wherein the movable member and the driving device are positioned adjacent to the particle accelerator within a test chamber and wherein the controller is mounted outside the test chamber.

19. A method of operating a beam diffuser selector apparatus for a particle accelerator, the beam diffuser selector apparatus including a movable member having a plurality of beam diffusers mounted thereon, each of the plurality of beam diffusers having a different predetermined thickness, and a driving device coupled to the movable member, comprising the steps of:

selecting one of the plurality of beam diffusers for use in a test; and causing the driving device to move the movable member such that the selected one of the plurality of beam diffusers is positioned in a test position which is adjacent to an output of the particle accelerator and between the output of the particle accelerator and a device under test.

20. The method of claim 19, further comprising the step of retracting the movable member away from the output of the particle accelerator once the test is complete.

* * * * *